US008292662B2

(12) United States Patent
Yang et al.

(10) Patent No.: US 8,292,662 B2
(45) **Date of Patent: *Oct. 23, 2012**

(54) WATERTIGHT CONNECTOR

(75) Inventors: Cheng-Wang Yang, Guang-Dong (CN); Kai-Hsiang Chang, Tu-Cheng (TW); Chao-Yong Ye, Guang-Dong (CN)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 159 days.

This patent is subject to a terminal disclaimer.

(21) Appl. No.: 12/885,529

(22) Filed: Sep. 19, 2010

(65) Prior Publication Data

US 2012/0071026 A1 Mar. 22, 2012

(51) Int. Cl.
*H01R 13/40* (2006.01)

(52) U.S. Cl. ..... 439/587; 439/271

(58) Field of Classification Search ..... 439/587, 439/589, 271, 281, 660, 607.35, 607.57, 439/607.58

See application file for complete search history.

(56) References Cited

U.S. PATENT DOCUMENTS

| | | | | |
|---|---|---|---|---|
| 5,975,917 | A * | 11/1999 | Wang et al. | 439/79 |
| 6,039,611 | A * | 3/2000 | Yang | 439/701 |
| 6,159,040 | A * | 12/2000 | Chang et al. | 439/541.5 |
| 6,354,886 | B1 * | 3/2002 | Yu | 439/701 |
| 6,409,542 | B1 * | 6/2002 | Ivey et al. | 439/607.58 |
| 7,922,535 | B1 * | 4/2011 | Jiang et al. | 439/607.35 |
| 8,011,956 | B1 * | 9/2011 | Yang et al. | 439/589 |

* cited by examiner

*Primary Examiner* — Xuong Chung Trans
(74) *Attorney, Agent, or Firm* — Cheng-Ju Chiang

(57) ABSTRACT

A watertight connector has a shell, an insulating housing wrapped in the shell, a plurality of terminals mounted into the shell, a fixing element fixed on the shell. A rear of the insulating housing is recess to form a receiving cavity for receiving a fixing block molded with a plurality of terminals, so there is no hole between the terminals and the insulating housing. A fixing element is fixed on the shell to seal openings of the shell for providing excellent waterproof property. So, all the openings of the watertight connector are sealed tightly. Also, the structure of the watertight connector is simple for reducing the production cost.

5 Claims, 3 Drawing Sheets

WATERTIGHT CONNECTOR

BACKGROUND OF THE INVENTION

1. Field of the Invention

The present invention relates to an electrical connector, and more particularly to an electrical connector capable of preventing water from permeating an inner side thereof.

2. The Related Art

A conventional electrical connector includes an insulating housing, a plurality of terminals mounted into the insulating housing, a metal shell wrapping the insulating housing. As the customer is strict about the product performance, the waterproof property is becoming more and more important. The current waterproof product is often provided with a sealing ring made of soft resin between the insulating housing and the shell and achieves waterproof effect by means of the shell pressing the sealing ring. However, the sealing ring is not steady because of the distortion thereof and there may be a crevice at one side of the sealing ring, the waterproof property of the product mentioned above is unsatisfactory and cannot meet customers' demand.

SUMMARY OF THE INVENTION

Accordingly, an object of the present invention is to provide a watertight connector. The watertight connector has a shell, an insulating housing wrapped in the shell, a plurality of terminals mounted into the shell, a fixing element fixed on the shell. The shell has a top plate, two opposite ends of the top plate extended downward to form a pair of lateral plates, a bottom plate connecting bottom ends of the lateral plates. The insulating housing has a base. A rear of the base is recessed to form a receiving cavity for receiving a fixing block. The terminal has a base portion molded in the fixing block, a contacting portion extended frontward into the insulating housing and a soldering portion exposed outside. The fixing block together with the terminals is fixed into the receiving cavity of the insulating housing. A fixing element is fixed on the shell for sealing the holes defined in the shell.

As described above, a plurality of terminals is molded in the fixing block which is fixed into the insulating housing, so there is no hole between the terminals and the insulating housing. The openings of the watertight connector are sealed tightly by the fixing element, which can effectively prevent water from permeating into the inner side of the watertight connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
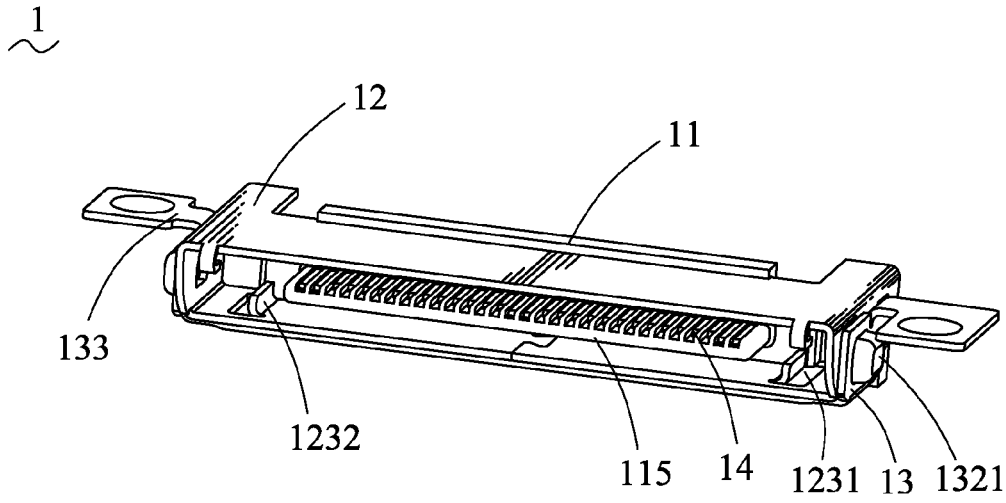
FIG. 1 is an assembled, perspective view of a watertight connector of an embodiment in accordance with the present invention.
Figure 2:
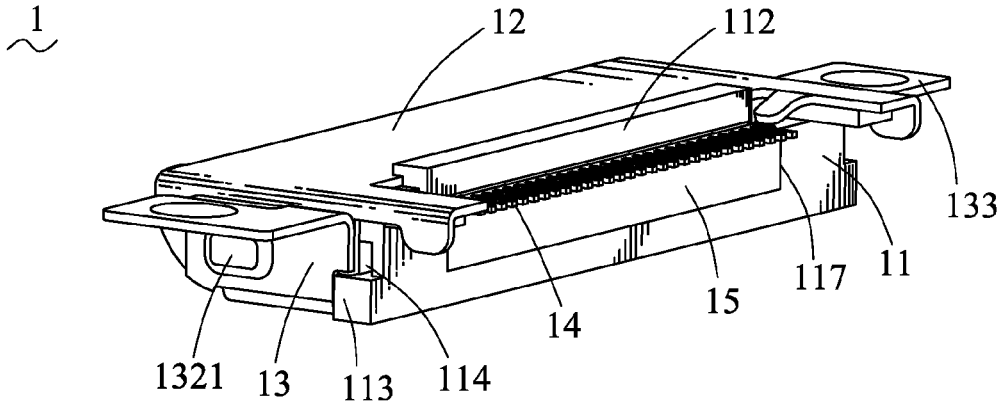
FIG. 2 is an assembled, perspective view of the watertight connector shown in FIG. 1 seen from another angle.
Figure 3:
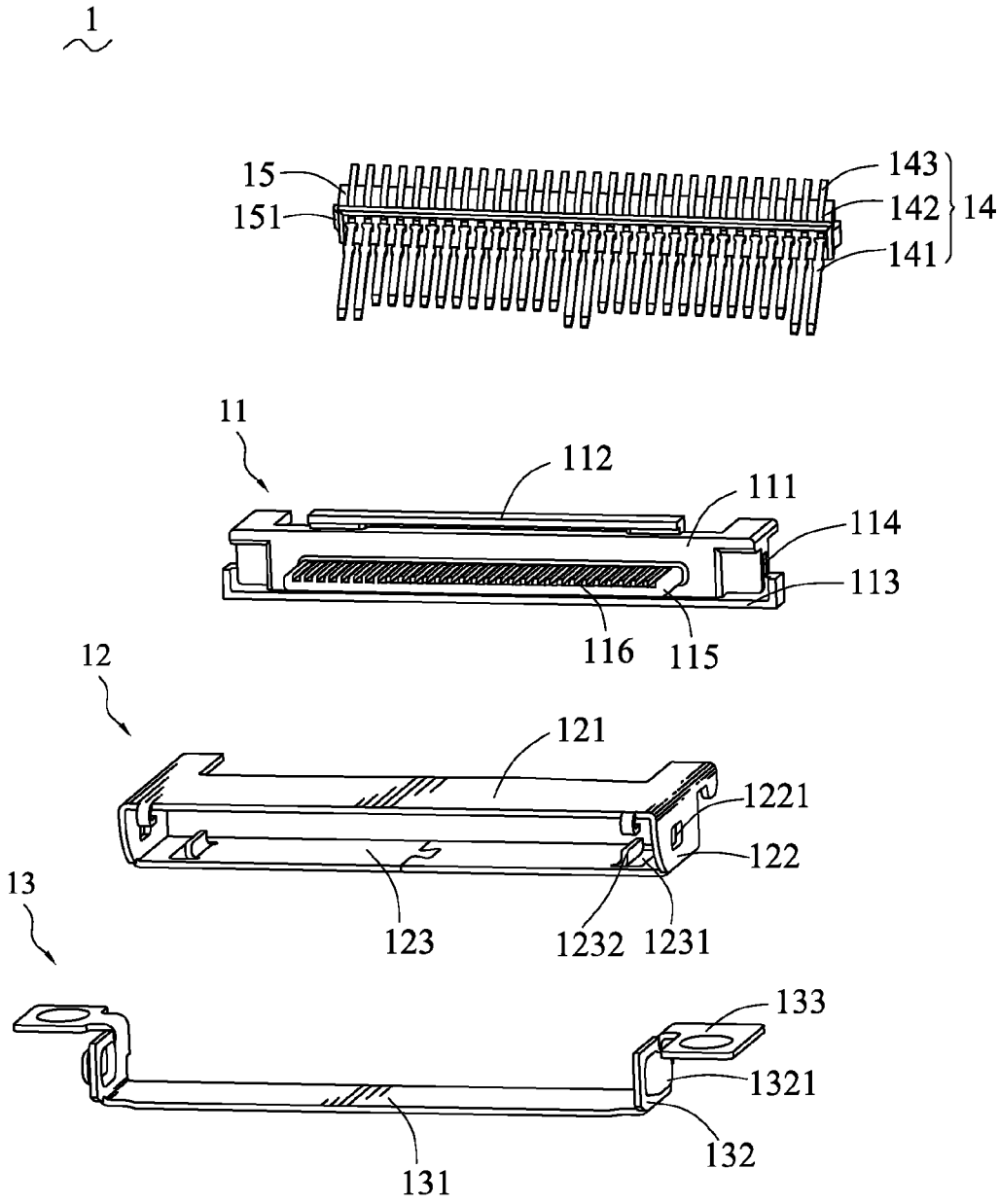
FIG. 3 is an exploded, perspective view of the watertight connector shown in FIG. 1.
Figure 4:
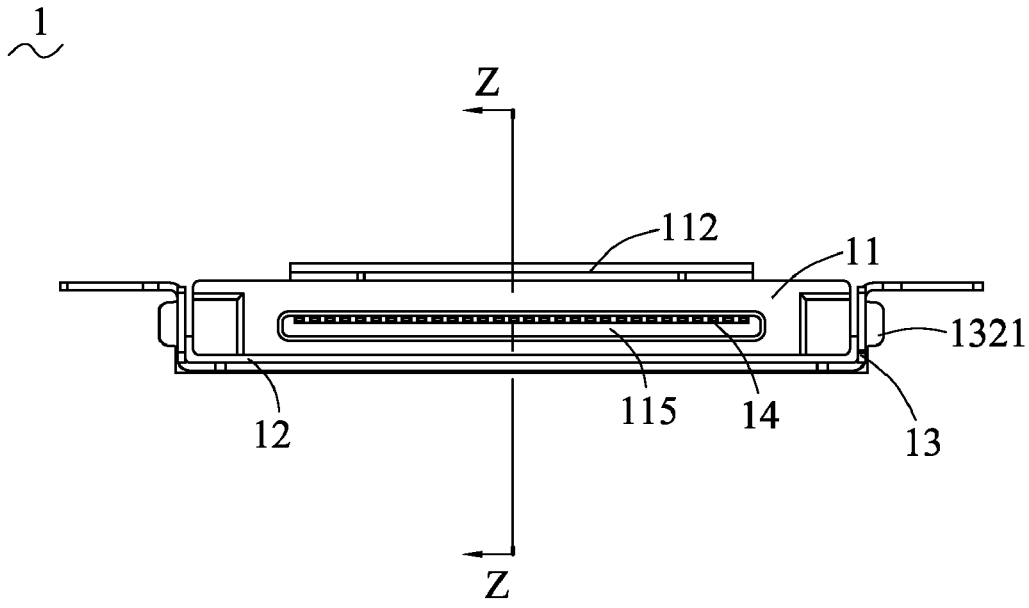
FIG. 4 is an assembled, front view of the watertight connector shown in FIG. 1.
Figure 5:
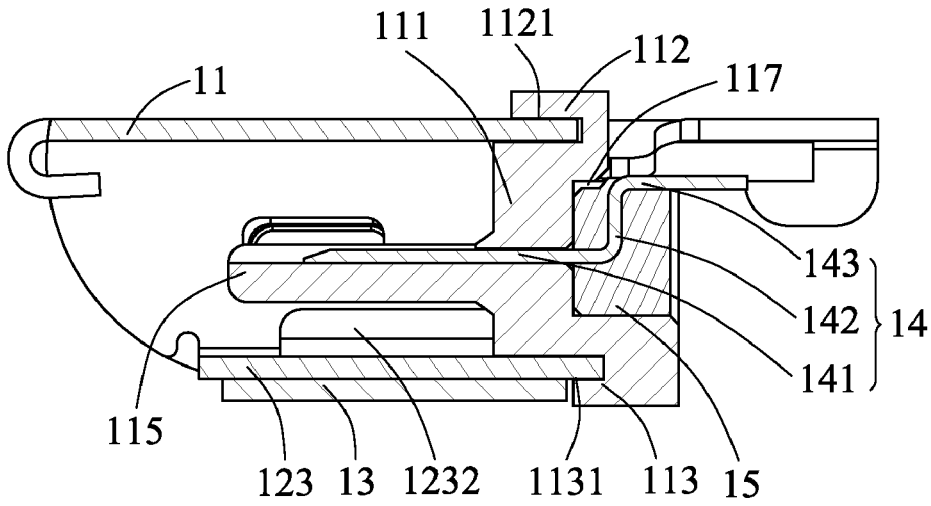
FIG. 5 is a cross-sectional view of the watertight connector shown in FIG. 4.

Referring to the drawings in greater detail, and first to FIGS. 1-3, the embodiment of the invention is embodied in a watertight connector 1. The watertight connector 1 includes an insulating housing 11, a plurality of terminals 14 mounted into the insulating housing 11, a shell 12 wrapping the insulating housing 11, a fixing element 13 fixing the shell 12 on the PCB (Printed Circuit Board).

With reference to FIGS. 2-3, the shell 12 has a top plate 121, two opposite sides of the top plate 121 are bent downward to form a pair of lateral plate 122, a bottom plate 123 connecting bottom ends of the lateral plates 122. Each lateral plate 122 forms a first through hole 1221 at a substantially middle portion thereof. Two opposite sides of the bottom plate 123 are respectively punched to form an end plate 1232 extending upward. A second through hole 1231 is formed corresponding to each end plate 1232.

The terminal 14 has a contacting portion 141, a rear end of the contacting portion 141 is extended upward to form a base portion 142, a free end of the base portion 142 is extended rearward to form a soldering portion 143. The base portion 142 is molded in a fixing block 15. The fixing block 15 of long rectangular shape integrates a plurality of terminals 14. Each lateral side of the fixing block 15 is protruded to form a bump 151.

The insulating housing 11 has a base 111. A top of the base 111 is protruded to form a first buckling portion 112. The first buckling portion 112 has a front side recessed to form a first buckling recess 1121 which is adjacent to the top of the base 111 and has two opposite ends opened freely. A bottom of the base 111 is protruded to form a second buckling portion 113. The second buckling portion 113 has a front side recessed to form a second buckling recess 1131 of substantially U-shape having two open top ends. The first buckling recess 1121 cooperates with the second buckling recess 1131 to receive a rear of the shell 12 for preventing water from permeating into an inner side of the insulating housing 11. A rear of the base 11 is recessed to form a receiving cavity 117 for receiving the fixing block 15. Each of two lateral sides of the receiving cavity 117 is recessed to form a fixing recess 114 corresponding to the bump 151. A front of the base 11 is extended frontward to form a tongue 115. The tongue 15 is formed with a plurality of terminal grooves 116 extending frontward and rearwards and communicating with the receiving cavity 117 for accommodating the corresponding contacting portion 141 of the terminals 14.

The fixing element 13 has a base slice 131, two opposite ends of the base slice 131 are extended upward to form a pair of lateral slices 132, a free end of each lateral slice 132 is extended perpendicularly and outwardly to form a fixing slice 133. A portion of the lateral slice 132 is punched outward to form a protrusion 1321 for avoiding any friction with a plug connector (not shown) mated with the watertight connector 1.

Referring to FIGS. 2-5, in assembly, the base portions 142 of the terminals 14 are molded in the fixing block 15. The contacting portion 141 is received in the terminal groove 116, while the soldering portion 143 is exposed outside of the insulating housing 11. The fixing block 15 is fixed in the receiving cavity 117 by means of the bump 151 buckling with the fixing recess 114. A rear of the top plate 121 is received in the first buckling recess 1121 and a rear of the bottom plate 123 is received in the second buckling recess 1131, so the shell 12 wraps the insulating housing 11 closely, which prevents water from permeating into the insulating housing 11 from gaps between the insulating housing 11 and the shell 12. In this embodiment, the fixing element 13 is fixed on the shell 12 by means of laser welding. The lateral slice 132 is fixed on the lateral plate 122 and seals the first through hole 1221. The base slice 131 is fixed under the bottom plate 123 and seals the second through holes 1231, so all the openings of the shell 12 are sealed tightly for preventing water from permeating into the inner side of the watertight connector 1.

As described above, a plurality of terminals 14 is molded in the fixing block 15 which is fixed in the insulating housing 11, so there is no hole between the terminals 14 and the insulating housing 11. The engagement between the top plate 121 and the first buckling recess 1121, and also between the bottom plate 123 and the second buckling recess 1131 can provide the watertight connector 1 excellent waterproof property. The first through hole 1221 and the second through holes 1231 are respectively sealed by the lateral slice 132 and the bottom slice 131. So, all the openings of the watertight connector 1 are sealed tightly, which can effectively prevent water from permeating into the inner side of the watertight connector 1. Also, the structure of the watertight connector 1 is simple for reducing the production cost.

What is claimed is:

1. A watertight connector, comprising:

an insulating housing having a base, a rear of the base recessed to form a receiving cavity for receiving a fixing block;

a shell for wrapping the insulating housing, and having a top plate, two opposite ends of the top plate extended downward to form a pair of lateral plates, and a bottom plate connecting bottom ends of the two lateral plates;

a plurality of terminals, each terminal including a base portion molded in the fixing block, a contact portion extended frontward into the insulating housing and a soldering portion exposed outside; and a fixing element fixed on the shell for sealing holes defined in the shell;

wherein the fixing element has a base slice fixed on the bottom plate for sealing a pair of second through holes formed at the base slice, and two opposite ends of the base slice are extended upward to form a pair of lateral slices fixed on the lateral plates for sealing first through holes formed at the lateral plates.

2. The watertight connector as claimed in claim 1, wherein lateral sides of the receiving cavity are recessed to form a pair of fixing recesses mating with bumps protruded from lateral sides of the fixing block for fixing the fixing block together with the terminals into the receiving cavity.

3. The watertight connector as claimed in claim 1, wherein a front of the insulating housing is protruded to form a tongue, the tongue is recessed to form a plurality of terminal grooves extending frontward and rearwards communicating with the receiving cavity for accommodating the corresponding contact portions of the terminals.

4. The watertight connector as claimed in claim 1, wherein a top of the base is protruded to form a first buckling portion having a front side recessed to form a first buckling recess for receiving a rear of the top plate, a bottom of the base is protruded to form a second buckling portion having a front side recessed to form a second buckling recess for receiving a rear of the bottom plate.

5. The watertight connector as claimed in claim 1, wherein a portion of the lateral slice is punched outward to form a protrusion for avoiding any friction with a plug connector mated with the watertight connector.

* * * * *